United States Patent [19]

Aktay et al.

[11] 4,065,385

[45] Dec. 27, 1977

[54] APPARATUS AND METHOD FOR SEPARATING A MIXTURE OF LIQUID AND COAL FINES

[75] Inventors: Ali I. Aktay, Munster, Ind.; Bohdan J. Bodnaruk, Homewood, Ill.; Michael O. Holowaty, Crown Point, Ind.

[73] Assignee: Inland Steel Company, Chicago, Ill.

[21] Appl. No.: 749,813

[22] Filed: Dec. 13, 1976

Related U.S. Application Data

[63] Continuation of Ser. No. 647,051, Jan. 7, 1976, abandoned.

[51] Int. Cl.[2] ..... B03D 1/24

[52] U.S. Cl. ..... 210/44; 210/60; 210/197; 210/221 P

[58] Field of Search ..... 209/166, 170; 210/44, 210/63 R, 63 Z, 221 P, 221 M, 60, 197

[56] References Cited

U.S. PATENT DOCUMENTS

| | | | |
|---|---|---|---|
| Re. 28,323 | 1/1975 | Silva | 210/221 M X |
| 2,695,710 | 11/1954 | Gibbs | 210/44 |
| 2,778,499 | 1/1957 | Chamberlain et al. | 210/44 X |
| 3,239,438 | 3/1966 | Voorhees | 210/44 X |
| 3,243,046 | 3/1966 | Kakumoto et al. | 210/221 P X |
| 3,307,701 | 3/1967 | Krofta | 210/221 P |
| 3,696,923 | 10/1972 | Miller | 210/44 X |
| 3,775,314 | 11/1973 | Beitzel et al. | 210/63 Z |
| 3,884,803 | 5/1975 | Traylor | 210/44 |
| 3,996,139 | 12/1976 | Prince et al. | 210/198 R |

*Primary Examiner*—Frank A. Spear, Jr.
*Assistant Examiner*—Robert H. Spitzer
*Attorney, Agent, or Firm*—Merriam, Marshall & Bicknell

[57] ABSTRACT

Coal fines are separated from a mixture containing liquid and coal fines in an apparatus comprising a combination surge tank and flotation tank employing air bubbles to urge the coal fines toward the overflow from the flotation tank.

12 Claims, 3 Drawing Figures

SETTLING TANK 22
STRAINER 41
CHARGING MAIN 40
TO INLET LINE 15
FLOTATION CELL 46
FILTER 49
FILTER CAKE

APPARATUS AND METHOD FOR SEPARATING A MIXTURE OF LIQUID AND COAL FINES

This is a continuation, of application Ser. No. 647,051, filed Jan. 7, 1976, abandoned.

BACKGROUND OF THE INVENTION

The present invention relates generally to apparatus and methods for separating fine coal particles from a mixture comprising said fine coal particles and a liquid, and more particularly to apparatus and methods for separating fine coal particles from a mixture obtained from the charging main of a system for the preheating and pipeline-charging of coal particles into coke ovens.

In the pipeline charging of coal into coke ovens, coal is subjected to a preliminary particulizing and preheating operation, and the coal particles are then conveyed by a fluid medium, such as steam, through a pipeline to the coke oven. A top opening in the coke oven communicates, through a conduit called a standpipe, with a conduit called a charging main. When the preheated coal particles are charged by pipeline into the coke oven, there is discharged, from the top opening in the coke oven through the standpipe into the charging main, a mixture known as carry-over and including fine coal particles (coal fines), coke oven gas, tar and steam. Typically, a liquid called flushing liquor is directed into the standpipe, and a liquid called charging liquid is directed into the charging main to precipitate the coal fines from the gas in the discharged mixture. The resulting mixture comprising coal fines and liquid is transported from the charging main to a facility for separating and recovering the coal fines from the mixture.

SUMMARY OF THE INVENTION

The present invention relates to an apparatus and method for improving the recovery of coal fines from the mixture of coal fines and liquid obtained from the charging main. This apparatus and method utilizes a tank which functions as a combination surge tank and flotation tank for the coal fines. The tank comprises a cylindrical upper portion and a conical lower portion tapering to an outlet at the bottom of the tank. The upper portion of the tank includes an inlet for introducing the mixture of coal fines and liquid obtained from the charging main. At least part of the liquid from the first mixture is removed from the lower portion of the tank and premixed with air bubbles to form a second mixture which is then introduced into the lower portion of the tank.

The tank includes a first outlet near the top of the tank, for removing from the upper portion of the tank, a froth of liquid, coal fines and air bubbles. The tank also includes a second outlet for removing liquid from the bottom of the tank. Withdrawal of material through the first and second outlets is controlled in such a manner as to define, in the tank, an upper first zone, in which forth is urged toward the first outlet in the upper portion of the tank, and a lower second zone, below the first zone, in which liquid is normally urged toward the second outlet at the bottom of the tank.

The first mixture is introduced into the upper first zone of the tank, and part of that mixture is withdrawn through the top outlet with the froth. Another part of the first mixture descends into the lower second zone of the tank, for withdrawal through the bottom outlet, because the rate of withdrawal of first mixture through the top outlet is normally less than the rate of introduction of first mixture into the upper zone.

The second mixture comprising air bubbles, liquid and a reduced percentage of coal fines, is introduced into the lower portion of the tank in the second zone thereof, at an elevation at which the rising air bubbles exert an upward force on the coal fines mixed with liquid in the second zone, to urge the coal fines toward the first outlet, in the upper zone of the tank, against the normal downward urging of the liquid descending in the second zone.

Thus, the air bubbles carry upward for withdrawal through the top outlet, not only coal fines initially premixed with the air bubbles in the second mixture but, also, coal fines descending into the second zone with liquid as first mixture from the upper first zone.

Other features and advantages are inherent in the method claimed and disclosed or will become apparent to those skilled in the art from the following detailed description in conjunction with the accompanying diagrammatic drawings.

DETAILED DESCRIPTION

Figure 1:
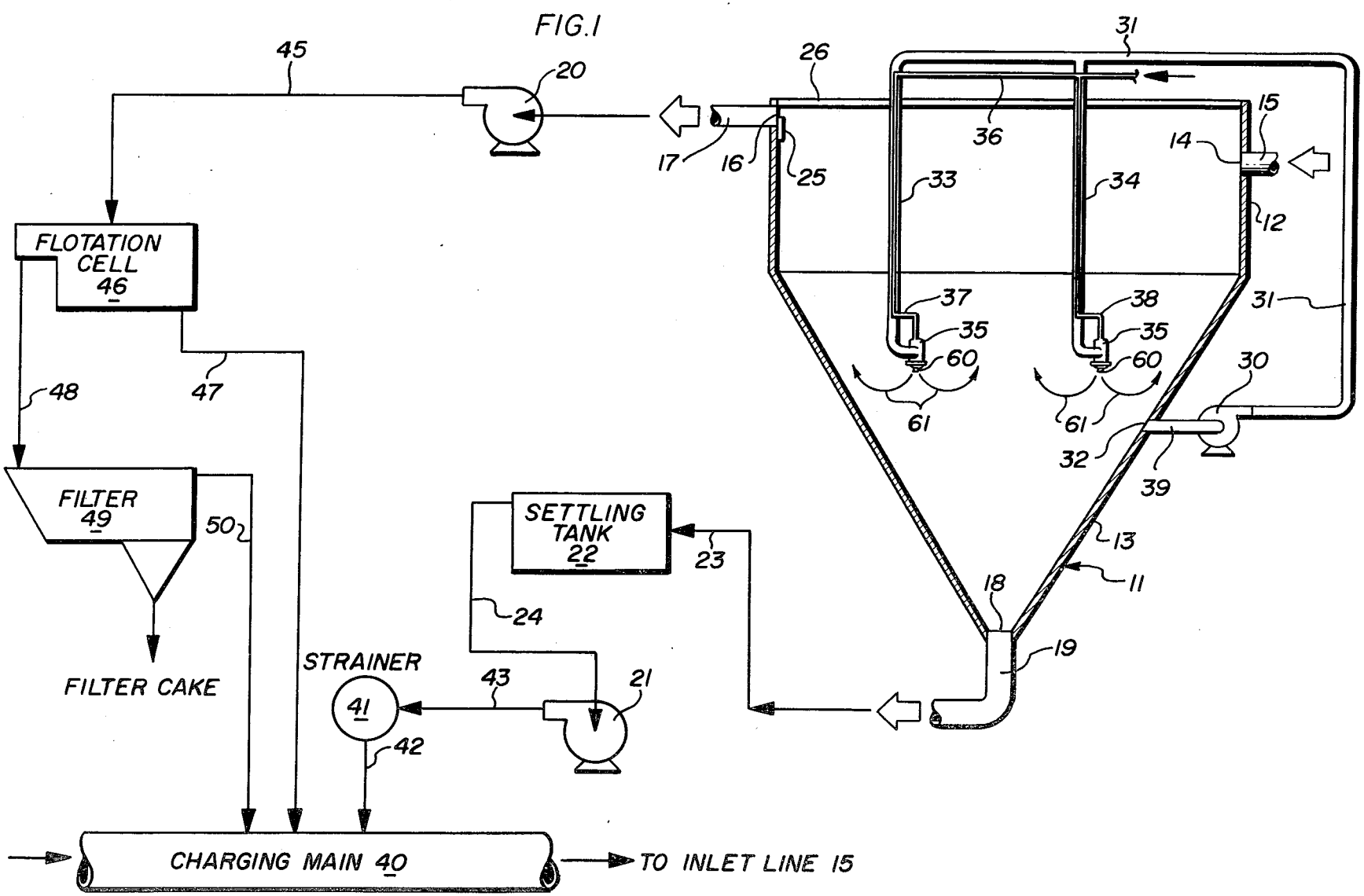
FIG. 1 is a schematic diagram of an apparatus for use in accordance with an embodiment of the present invention and showing a combined surge tank-flotation cell in vertical section.

Referring initially to FIG. 1 there is shown a tank indicated generally at 11 and which functions as a combined surge tank and flotation tank for separating coal fines from a mixture comprising liquid (e.g., ammoniacal liquor) and coal fines obtained from the charging main 40 of a system for the pipeline charging of coal into coke ovens. A surge tank conventionally performs the function of evening out the flow of liquid downstream of the surge tank to prevent fluctuations in that flow.

Tank 11 comprises an upper cylindrical portion 12 and a lower conical portion 13 tapering downwardly toward the bottom of the tank. Upper portion 12 includes an inlet 14 communicating with an inlet line 15 communicating with charging main 40. The first mixture of coal fines and liquid from charging main 40 is introduced into tank 11 through inlet 14.

Upper tank portion 12 also includes a first outlet 16 communicating with an outlet line 17 in turn communicating with a first outlet pump 20. The rate of withdrawal of liquid through outlet 16 is controlled by a vertically adjustable gate or weir 25 of conventional construction.

Lower tank portion 13 has a bottom or second outlet 18 communicating with a bottom outlet line 19 in turn communicating via a line 23 with a conventional settling tank 22 from which liquid is pumped by a pump 21 through a line 24.

Material is withdrawn from tank 11 through upper outlet 16 by the urging of pump 20 and through lower outlet 18 by the urging of gravity. Simultaneous withdrawal of material through upper and lower outlets 16, 18 defines, in tank 11, a first zone extending down from the top of the tank, in which zone froth is urged toward first outlet 16, and a second zone, located below the first zone, in which liquid is normally urged toward second outlet 18. The line of demarcation between the first and second zones depends upon the respective withdrawal rates through outlets 16, 18. The line of demarcation can be raised by raising adjustable weir 25 and the line of demarcation can be lowered by doing the reverse. The weir is adjusted so that the line of demarcation is always located below inlet 14. The nearer a volume of material descends to outlet 18 at the bottom of the second zone, the stronger the force urging withdrawal through that outlet.

Located at lower tank portion 13 is an outlet 32 through which liquid from lower tank portion 13 is withdrawn into a conduit 39 communicating with a pump 30 for pumping the withdrawn liquid through a conduit 31 communicating with branch conduits 33, 34 in turn communicating with premixers 35, 35 located in lower tank portion 13 above outlet 32. Also communicating with premixers 35, 35 are branch air lines 37, 38 connected to a main air line 36 connected to a source of compressed air (not shown). Air lines 36, 37, 38 introduce compressed air into premixers 35, 35 to form fine air bubbles in the liquid. A second mixture comprising air bubbles, coal fines and liquid exits from premixers 35, 35.

Premixers 35, 35 are located below inlet 14, in lower tank portion 13 and below the line of demarcation which divides the upper zone from the lower zone. The second mixture exits from each premixer 35 downwardly through an opening 60 in the bottom thereof. The air bubbles in the downwardly directed second mixture change direction and move upwardly, following an initial path defined generally by the arrows 61 in FIG. 1. The air bubbles leaving premixers 35 carry upwardly not only the coal fines premixed with the air bubbles in premixers 35, but also a substantial portion of the coal fines descending to the level of premixers 35 after being introduced through first inlet 14 in upper cylindrical tank portion 12, as described more fully below.

Premixers 35, 35 are at an elevation in the second zone at which the rising air bubbles exert an upward force on the coal fines at that level greater than the downward urging of the descending liquid there, to urge the coal fines in the second zone, at the elevation of premixers 35, 35 and thereabove, upwardly toward first outlet 16. The net result is that a substantial portion of the coal fines mixed with the liquid in the first mixture, and descending from the first to the second zone, is urged back upwardly into the first zone and out through first outlet 16.

Accordingly, the liquid withdrawn from the bottom of the tank through second outlet 18 has a much lower percentage of coal fines than the liquid withdrawn through first outlet 16 at the top of the tank, and the liquid withdrawn from first outlet 16 has a substantially higher percentage of coal fines than was contained in the first mixture introduced into the tank at inlet 14. In a typical operation, the proportion of coal fines in the first mixture introduced through inlet 14 is 6000 ppm (parts per million). The proportion of coal fines in the liquid withdrawn from bottom outlet 18 is 500 ppm, and the balance of the incoming coal fines is in the liquid withdrawn from first outlet 16, at the top of the tank. Thus, less than 10% of the incoming fines are withdrawn through bottom outlet 18.

Recycle outlet 32 is preferably located just below the level at which air bubbles, descending from premixer bottom openings 60, begin to rise. Thus, material withdrawn from tank 11 at recycle outlet 32 consists primarily of liquid, without air bubbles, and from which the greater portion of solids has already been removed. If recycle outlet 32 were higher, at a level where there was a relatively large proportion of solids in the liquid, the recycled liquid (with increased solids therein) would have an increased erosive effect on the recycling equipment through which it flowed. As shown in FIG. 1, not only is recycle outlet 32 lower than the level at which the second mixture is introduced but, also, it is above the level of bottom outlet 18 through which liquid is withdrawn. Thus, the liquid urged toward the bottom outlet is subjected to an interception operation, at the level of recycle outlet 32, before that liquid reaches the level of the bottom outlet. As noted above, liquid intercepted and removed through recycle outlet 32 is mixed with air bubbles and recycled through premixers 35 thereby subjecting the fines in the intercepted and recycled liquid to a further fines-removing effect.

The apparatus may employ more than the two premixers illustrated in the drawing. However, no matter the number of premixers, at least some, and preferably all, should be located in the second zone and at a level where the rising air bubbles overcome the downward urging of the descending liquid on the coal fines. By so locating the premixers, the coal fines entering therethrough are urged toward the top of the tank while the liquid entering through the premixers is urged toward the bottom of the tank. The net result is to increase the ratio of coal fines to liquid withdrawn through first outlet 16 at the top of the tank, and this is desirable.

Generally, better recovery of coal fines through top outlet 16 is obtained if premixers 35 are located in conical lower portion 13 than if they are located in upper cylindrical portion 12, with one precaution noted in the following paragraph.

The downwardly converging side walls of conical lower portion 13 cause a downward acceleration of the liquid and of any fines entrapped therein, as the liquid descends in conical portion 13. Therefore, if premixers 35, 35 were placed too far down in conical portion 13, the downward acceleration of the liquid and its entrapped fines at that level may be too great to be overcome by the upward force exerted on the fines by the air bubbles. This would permit more coal fines to continue to move downwardly and reduce the percentage thereof recovered through top outlet 16. Accordingly, the depth of premixers 35 must be at a location where the upward force of the rising air bubbles on the coal fines exceeds the downward pull of the liquid in the conical portion.

Lower conical tank portion 13, in addition to cooperating with other parts of the apparatus for effecting a separation of coal fines from the liquid, as described above, also functions as a surge tank to even out the flow of liquid downstream of bottom outlet 18.

Liquid with a relatively high percentage of coal fines is withdrawn through first outlet 16 and pumped by pump 20 through a line 45 to a conventional flotation cell 46. The overflow from the flotation cell, containing most of the fines, is conducted through a line 48 to a conventional filter 49 where the fines are processed into filter cake.

The liquid from filter 49 is withdrawn through a line 50 and recycled to charging main 40. The liquid under-flow from flotation cell 46 is withdrawn by a line 47 and flows to charging main 40.

Communicating with settling tank 22 is outlet line 19 connected to tank bottom outlet 18. Outlet line 19 carries liquid, with a relatively low percentage of coal fines, from the bottom of the tank to settling tank 22 at which residual coal fines are settled out from the liquid and then removed for disposal. Liquid, from which residual coal fines have settled, is withdrawn from the top of the settling tank through a line 24 by pump 21 and directed through a line 43 to a conventional strainer 41 which removes remaining amounts of residual coal fines. Liquid from strainer 42 is recycled to charging main 40.

Figure 2:
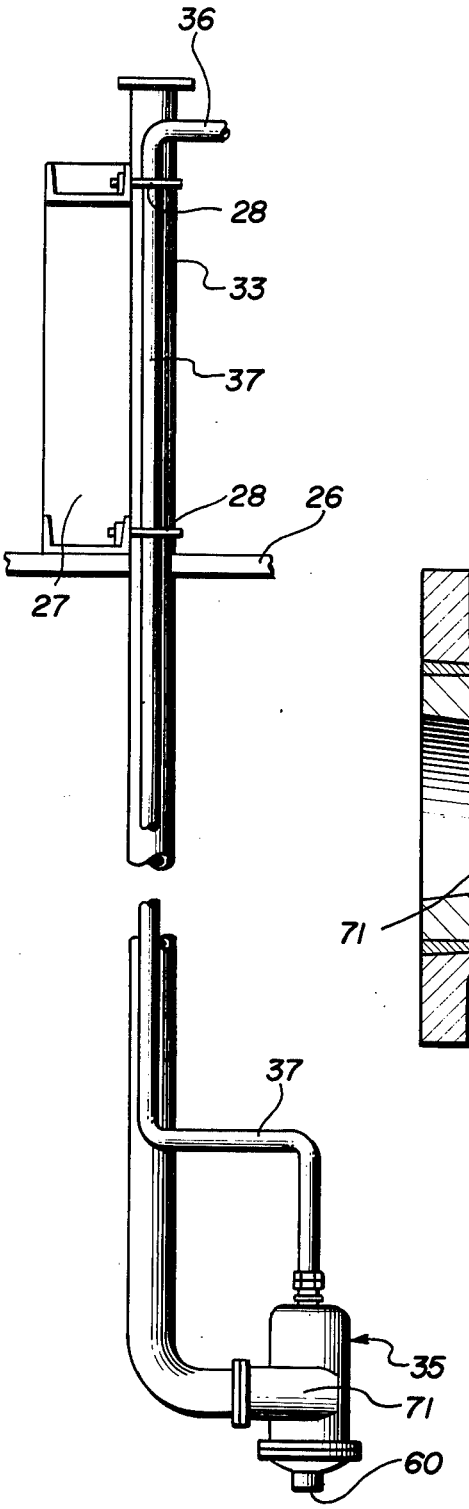
FIG. 2 is a fragmentary, vertical sectional view showing a premixing device for use in conjunction with the apparatus of FIG. 1.

Referring now to FIG. 2, tank 11 includes a top frame 26 on which is located a premixer frame 27 for supporting branch conduit 33 and branch air line 37 connected to premixer frame 27 by fastening means 28. The same type of arrangement is used for supporting branch conduit 34 and branch air line 38 (FIG. 1).

Figure 3:
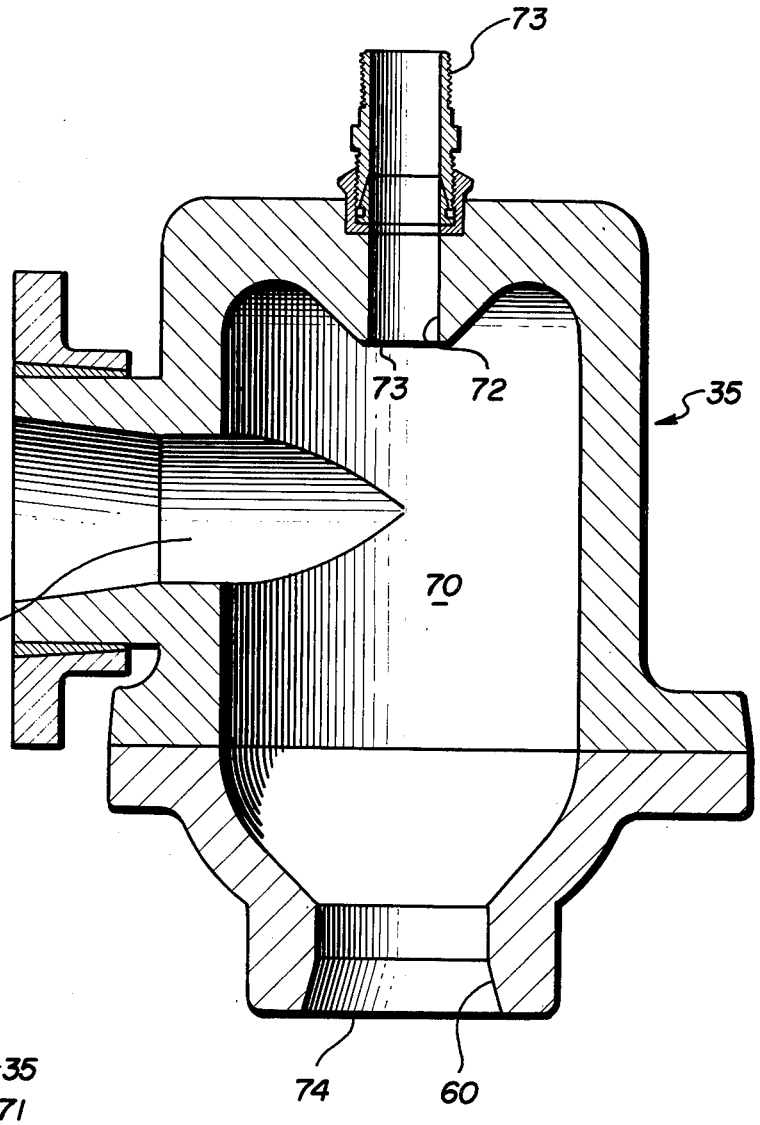
FIG. 3 is an enlarged vertical sectional view of a premixing chamber utilized in conjunction with the premixing device of FIG. 2.

Referring to FIG. 3, each premixer 35 comprises a vertically disposed, cylindrical vortex chamber 70 communicating with first inlet means 71 for introducing tangentially into vortex chamber 70 the liquid which is recycled from lower tank portion 13. This liquid, containing a relatively small proportion of coal fines, whirls and descends through vortex chamber 70.

Extending downwardly into the upper portion of vortex chamber 70 is second inlet means 72, located above first inlet means 71, for introducing compressed air downwardly into the vortex chamber, along the vertical axis thereof. The compressed air is broken up into fine bubbles due to a shearing action with the liquid entering through tangential inlet 71. A coupling 73 connects air inlet 72 with air branch line 37.

Located below first inlet means 71, at the bottom of vortex chamber 70 is outlet means 60 through which the second mixture, comprising air bubbles, coal fines and liquid, leaves premixer 35. As noted above, the second mixture is directed by premixer 35 downwardly into the second zone of tank 11.

The air bubbles contained in the second mixture formed within premixer 35 have a size in the range 50 to 100 microns. Air bubbles in this range have been found to have a separating efficiency 10 times greater than air bubbles having a size of about 500 microns. The finer air bubbles carry more coal fines upwardly into the first zone for removal through first outlet 16 than do larger bubbles.

If compressed air were introduced into tank 11 at 60 without first being premixed with liquid in the manner described above, the air would enter the tank as big bubbles. By mixing the air with liquid so as to produce a shearing action, as described above, the air is broken up into fine bubbles, and separation of coal fines from liquid in tank 11 is enhanced.

Following is an example of a typical operation employing the above-described apparatus. The rate of flow of the first mixture through inlet 14 is about 1850 gallons per minute. The rate of flow of recycled liquid into premixers 35, 35 is about 300 gallons per minute, with about 150 gallons per minute being introduced into each premixer 35. The pressure of the liquid introduced through lines 33, 34 into the premixers 35, 35 is about 20 lbs. per square inch. The air pressure of the air introduced into premixers 35, 35 is about 1½ to 2 psi. The rate of removal through first outlet 16 is about 500 gallons per minute (liquid with an increased percentage of coal fines therein) and the rate of removal through bottom outlet 18 is about 1350 gallons per minute (liquid with a reduced percentage of coal fines therein).

Under the conditions described above, the optimum flow rate of liquid through premixers 35 is about 150 gallons per minute. A lower flow rate produces less shearing action and larger bubbles. A higher flow rate doesn't significantly increase the shearing action to the extent warranted by the increase in power required to pump the higher flow rate.

The size of the fine coal particles in the mixture from the charging main is as follows:

| Tyler Mesh Size | Frequency, % | Cumulative Frequency, % |
|---|---|---|
| 20 mesh | 36.8 | 36.8 |
| 50 mesh | 36.0 | 72.8 |
| 100 mesh | 14.2 | 87.0 |
| 325 mesh | 13.0 | 100.0 |

When the coal particles were introduced into the coke ovens the particles were subjected to a temperature of about 1800° F., causing some of the fine particles to puff up, like popcorn, thereby lowering their density and enhancing the ability of these coal particles to be carried upwardly by the air bubbles in the flotation operation performed in tank 11. In addition, the preheated fine coal particles discharged into the charging main from the coke ovens have associated with them some coal tar which produces a flocculating effect on the fine coal particles to further facilitate their separation from the liquid.

In a typical embodiment, tank 11 has an outer diameter, at its upper cylindrical portion 12, of about 16 ft., and a depth from top frame 26 to bottom outlet 18 of about 21 ft. The middle of inlet line 15 is located about two feet below the top of tank 11. Conical portion 13 tapers from an outside diameter of 16 ft. at the top thereof to a diameter of about 1 ft. at bottom outlet 18. The depth of upper cylindrical portion 12 is about 6 ft., and the vertical distance from tank top 26 to outlet 60 in a premixer 35 is about 8 ft.

Recycle outlet 32 is located about halfway from the top to the bottom of conical portion 13, consistent with the considerations discussed above regarding avoiding the recycling of air bubbles. Air branch lines 37, 38 have a diameter of about 1¼ inches. Conduits 33, 34 for introducing the first mixture into premixer 35 each have a diameter of about 2½ inches. Chamber 70 has a diameter of about 4¾ inches, and a vertical dimension, from the bottom edge 73 of air inlet 72 to the bottom edge 74 of outlet 60, of about 8¾ inches.

The foregoing detailed description has been given for clearness of understanding only, and no unnecessary limitations should be understood therefrom, as modifications will be obvious to those skilled in the art.

What is claimed is:

1. An apparatus for separating coal fines from a mixture of liquid and coal fines, said apparatus comprising:

a tank including an unconverging upper portion and a downwardly converging lower portion;

first outlet means for removing froth from the upper portion of said tank;

second outlet means at the bottom of said tank for removing liquid from said tank;

means for withdrawing liquid from said tank through said first and second outlet means and for providing in said tank a first zone in which liquid is urged toward said first outlet means and a second zone, below said first zone, in which liquid is normally urged downwardly toward said second outlet means;

said downwardly converging lower tank portion comprising means for accelerating the downward movement of liquid in said second zone as the downwardly moving liquid approaches said second outlet means;

means for introducing into said tank a first mixture comprising liquid and coal fines;

means for premixing air with at least a portion of the liquid from said first mixture to form a second mixture comprising said liquid and bubbles of air;

and means for introducing said second mixture into said downwardly converging lower portion, substantially below said unconverging upper portion, in said second zone at a level at which rising air bubbles from said second mixture exert an upward force on coal fines mixed with liquid in said second zone sufficient to overcome the downward urging of the liquid on the coal fines, for the acceleration the liquid undergoes at that level as a result of said downwardly converging lower tank portion, and to urge said coal fines at that level toward said first outlet means.

2. An apparatus as recited in claim 1 and comprising:

means for recycling first mixture liquid from said lower portion of the tank to said premixing means;

said recycling means including outlet means for said liquid located below the level at which said second mixture is introduced into said second zone and substantially above said second outlet means for subjecting the liquid urged toward said second outlet means to an interception operation before that liquid reaches the level of said second outlet means.

3. An apparatus as recited in claim 2 wherein said recycling outlet means is located below the level at which said air bubbles begin to rise.

4. An apparatus as recited in claim 2 wherein said recycling means comprises means for recycling said first mixture liquid at a rate which produces a shearing action with said air in said premixing means to produce fine air bubbles having a size in the range of 50–100 microns.

5. An apparatus as recited in claim 4 wherein said premixing means comprises:

a vortex chamber;

first inlet means for introducing said mixture tangentially into said vortex chamber;

second inlet means, located above said first inlet means, for introducing air downwardly into said vortex chamber to premix said air and said mixture;

and outlet means for said second mixture located below said first inlet means.

6. An apparatus as recited in claim 1 wherein said introducing means for the second mixture comprises means for directing said second mixture downwardly into said second zone.

7. An apparatus as recited in claim 1 wherein said tank is a surge tank.

8. A method for separating, in a tank, coal fines from a mixture of liquid and coal fines, said method comprising the steps of:

providing a liquid-containing tank with an unconverging upper portion, a downwardly converging lower portion, a first outlet for removing froth from said upper portion of said tank and a second outlet for removing liquid from the bottom of the tank;

simultaneously withdrawing liquid from said tank through said first and second tank outlets at respective withdrawal rates which cooperate to provide, in the tank, a first zone in which said liquid is urged toward said first outlet and a second zone, below said first zone, in which said liquid is normally urged downwardly toward said second outlet;

accelerating the downward movement of liquid in said second zone as the downwardly moving liquid descends through said downwardly converging lower tank portion and approaches said second outlet;

introducing a first mixture of said liquid and said coal fines into said tank;

premixing air with at least a portion of the liquid from said first mixture, to form a second mixture comprising said liquid and air bubbles;

and introducing said second mixture into said downwardly converging lower portion, substantially below said unconverging upper portion, in said second zone at a level at which rising air bubbles from said second mixture exert an upward force on coal fines mixed with liquid in said second zone sufficient to overcome the downward urging of the liquid on the coal fines, for the acceleration the liquid undergoes at that level as a result of its descent through said downwardly converging lower tank portion, and to urge said coal fines at that level toward said first outlet.

9. A method as recited in claim 8 and comprising the further step of:

recycling first mixture liquid from a lower portion of said tank for premixing with said air to form said second mixture;

said recycling step comprising withdrawing said first mixture liquid from a location in said tank below the level at which said second mixture is introduced into said second zone and substantially above said second outlet to subject the liquid urged toward said second outlet to an interception operation before that liquid reaches the level of said second outlet.

10. A method as recited in claim 9 wherein said withdrawing location is below the level at which said air bubbles begin to rise.

11. A method as recited in claim 9 wherein said recycling step comprises recycling said first mixture liquid at a rate which produces a shearing action with said air during said premixing step to produce fine air bubbles having a size in the range 50–100 microns.

12. A method as recited in claim 8 wherein said last-recited introducing step comprises directing said second mixture downwardly into said second zone.

* * * * *